US005206616A

United States Patent [19]

Stegmüller

[11] Patent Number: 5,206,616

[45] Date of Patent: Apr. 27, 1993

[54] SWITCHING DEVICE FOR THE INTERRUPTION OF FAULT CURRENTS

[75] Inventor: Karl Stegmüller, Wiesent, Fed. Rep. of Germany

[73] Assignee: Sachsenwerk Aktiengesellschaft, Regensburg, Fed. Rep. of Germany

[21] Appl. No.: 728,232

[22] Filed: Jul. 10, 1991

[30] Foreign Application Priority Data

Jul. 10, 1990 [DE] Fed. Rep. of Germany ..... 4021945

[51] Int. Cl.[5] ..... H01H 67/02

[52] U.S. Cl. ..... 335/126; 200/144 B

[58] Field of Search ..... 200/144 B; 335/18, 126; 361/42-50

[56] References Cited

U.S. PATENT DOCUMENTS 4,568,804 2/1986 Luehring ..... 200/144 B

FOREIGN PATENT DOCUMENTS 1752494 5/1957 Fed. Rep. of Germany .
1171051 5/1964 Fed. Rep. of Germany .
2442936 3/1975 Fed. Rep. of Germany .
2758264 7/1979 Fed. Rep. of Germany .
8310906 8/1983 Fed. Rep. of Germany .
3318229 1/1984 Fed. Rep. of Germany .
8303264 2/1984 Fed. Rep. of Germany .
3412250 10/1985 Fed. Rep. of Germany .
3415743 10/1985 Fed. Rep. of Germany .
3422949 12/1985 Fed. Rep. of Germany .
8805942 9/1988 Fed. Rep. of Germany .
601906 7/1978 Switzerland .

OTHER PUBLICATIONS

Schemmann, "Vakuum-Leistungsschalter in Ortsnetzverteilerstationen", etz Bd. 108 (1987) Heft 16, pp. 754-759.

Prospekt, "Fluarc FG 1", Merlin Gerin, Jul. 9th, 1984, D/B 513.

*Primary Examiner*—Lincoln Donovan
*Attorney, Agent, or Firm*—Spencer, Frank & Schneider

[57] ABSTRACT

A switching device for the interruption of a fault current includes a housing having first and second electrical connectors for connection in the path of an electrical conductor carrying a single current phase. A vacuum switching chamber is disposed in the housing. A current transformer disposed in the housing includes a primary circuit connected between the first and second terminals for conducting the single current phase and inducing a corresponding current in a secondary winding. A magnet actuator disposed in the housing is electrically coupled to the transformer secondary winding. The magnet actuator is responsive to a fault current in the transformer primary, by way of the corresponding current in the secondary, for changing from an inactive state to an actuated state. A latch disposed in the housing is connected for latching the movable switch contact in a closed position and for being unlatched in response to a change to the actuated state of the magnet actuator for moving the movable switch contact to an open position. A turn-off spring causes the latch to move the movable switch contact away from the stationary switch contact when the latch becomes unlatched.

27 Claims, 5 Drawing Sheets

SWITCHING DEVICE FOR THE INTERRUPTION OF FAULT CURRENTS

CROSS REFERENCE TO RELATED APPLICATIONS

The present application claims the rights of priority with respect to application Ser. No. P 40 21 945.3 filed Jul. 10, 1990 in Germany, the subject matter of which is incorporated herein by reference.

BACKGROUND OF THE INVENTION

The present invention relates to a switching device for the interruption of a fault current, preferably for a transformer branch in a medium voltage switching system; and more particulary to such a switching device which is suitable for the performance of repeated interruptions and is actuated by an energy store including at least one turn-off spring and an actuating device which becomes active upon the occurrence of a fault current.

Such a switching device is employed with preference in closed line switching systems which are generally composed of two closed line loops and at least one switching panel for a transformer branch. A known switching device of the foregoing type is disclosed in a publication by CALOR-EMAG, entitled "Schaltanlage für Ortsnetzverteilerstationen mit Vakuum-Leistungsschalter" [Switching System For Local Network Distributor Stations Equipped With A Vacuum Power Switch], by Klaus Böttger and Bruno Schemann, Special Printing from *Elektrotechnische Zeitschrift* {*Electrical Engineering Magazine*}, Volume 106, No. 10, (1985). The closed line terminals are each equipped with a power circuit breaker and the transformer tap with a vacuum power switch. The latter, in conjunction with an excess current relay fed by a current transformer, provides short-circuit protection for this branch.

The cited switching system, which is insulated by $SF_6$ gas, is considered to be fully insulated since the short-circuit protection is no longer provided by EHV (extra high voltage) fuses disposed outside the encapsulation. Moreover, the switching system is considered to be maintenance free since, after the interruption of a short-circuit current, a possibly remote, controllable renewed turn-on of the power switching device permits resumption of operation without having to exchange an operating medium, such as, for example, the fuses. The absence of EHV fuses additionally precludes further sources of error right from the start, such as the existence of a critical current range in which a fuse fails to respond, or responds only after a very long period of melting, and in which therefore the danger of overheating and explosion exists. Moreover, it is noted, among others, that safety characteristics fluctuate considerably and that the power circuit breaker is overloaded in the borderline region of the fuse.

On the other hand, in the cited switching system, the vacuum power switch must have the full insulating capability as specified, for example, by applicable VDE [Vorschriftenwerk Deutscher Elektrotechniker=Rules for German Electrical Engineers] rules and must be able, by the layout of its contacts and the energy store, to turn off short-circuit currents without welding.

In the connection region, that is, outside of the encapsulation of the switching system, sufficient space must be provided for the necessary cable transformers. The excess current relays must additionally be checked a certain time intervals in routine monitoring which is possible only if the branch can be separated. With the prior art switching device, a three-phase interruption of the branch is made even if the fault is only in a single phase, although in many cases it would be of advantage to maintain two-phase emergency operation. This applies primarily for rigidly grounded networks as they are used in many countries overseas. If one employs the prior art switching device in a switching system that is insulated by air, all its elements are fully exposed to the climate of the environment.

SUMMARY OF THE INVENTION

It is an object of the present invention to provide a switching system that can be employed as a single-phase, autonomous operating means for the repeated interruption of short-circuit currents.

It is a further object of the present invention to provide a switching system in which all elements of the switching device are fully protected against environmental influences, that is, also against a corrosive climate.

The above and other objects are accomplished according to the invention by the provision of a switching device for the interruption of a fault current, comprising: a housing including first and second electrical connectors for connection in the path of an electrical conductor carrying a single current phase, the housing being associated solely with the single current phase; a vacuum switching chamber disposed in the housing; a stationary switch contact and a movable switch contact disposed in the vacuum switching chamber and connected, respectively, to the first and second electrical connectors; a current transformer disposed in the housing and including a secondary circuit and a primary circuit connected between the first and second terminals for conducting the single current phase and inducing a corresponding current in the secondary circuit; magnet actuator means disposed in the housing and electrically coupled to the secondary circuit of the transformer, the magnet actuator means having an inactive state and an actuated state and being responsive to a fault current in the primary circuit of the current transformer, by way of the corresponding current in the secondary circuit, for changing from the inactive state to the actuated state; latch means disposed in the housing, connected to the movable switch contact for latching the movable switch contact in a closed position with respect to the stationary switch contact and for being unlatched in response to a change to the actuated state of the magnet actuator means for moving the movable switch contact to an open position relative to the stationary switch contact; a turn-off spring for storing a spring force and operatively associated with the latch means for causing the latch means, under influence of the spring force, to move the movable switch contact away from the stationary switch contact when the latch means becomes unlatched; and reset means operatively connected to the latch means for causing the latch means to latch the movable contact in the closed position and for restoring the spring force of the turn-off spring subsequent to the latch means being unlatched in response to a fault current.

The switching device according to the invention contains all operationally significant elements in a single-phase housing and is therefore suitable for a phase-wise interruption of fault currents. Additionally, the housing may also be made gas tight so that the protective device according to the invention also results in a noticeable improvement in the service life of air-insulated switching systems, primarily in humid or corrosion endangered environments.

The switching device according to the invention is autonomous because it includes a power store and an actuating system as well as a resetting device which can be operated easily from the operator's side even in encapsulated, gas insulated switching systems. Due to the built-in vacuum switching chamber, the switching device has an almost unlimited service life.

The resetting device is preferably in the form of a screw spindle so that the vacuum switching chamber can be turned on again after each interruption due to a fault and the turn-off spring can be latched again. According to one aspect of the invention, a shaft is attached to the movable switch contact and the shaft, or an extension thereof, of the movable switch contact transfers the switching movement toward the outside of the housing and there enables the indication of the switch position or, by way of connecting means, the actuation of an associated power circuit breaker.

According to another aspect of the invention, the secondary winding of the current transformer and a toroidal coil of the magnet actuator means are connected in series without using an outside energy source. If a fault current is present in the primary of the current transformer, the induced secondary current is utilized to actuate the magnet actuator means and to thus release the latch means. The turn-off spring then turns the vacuum switching chamber off. Upon removal of the fault, the screw spindle is employed to turn the vacuum switching chamber on again. Because the switching device according to the invention includes a built-in vacuum switching chamber, it is able to interrupt an almost unlimited number of faults without access to the interior of the switching device. It can therefore be installed within the encapsulation of gas insulated switching systems and is thus at the same high insulation level as the operating means present in the gas atmosphere. On the other hand, the housing of the switching device according to the invention can be made gas tight so that its internal functions are not influenced by environmental influences such as corrosion, humidity, etc. when the device is employed in air insulated systems.

For a better understanding of the invention, reference is made to the following drawing figures:

DETAILED DESCRIPTION OF PREFERRED EMBODIMENTS

Figure 1:
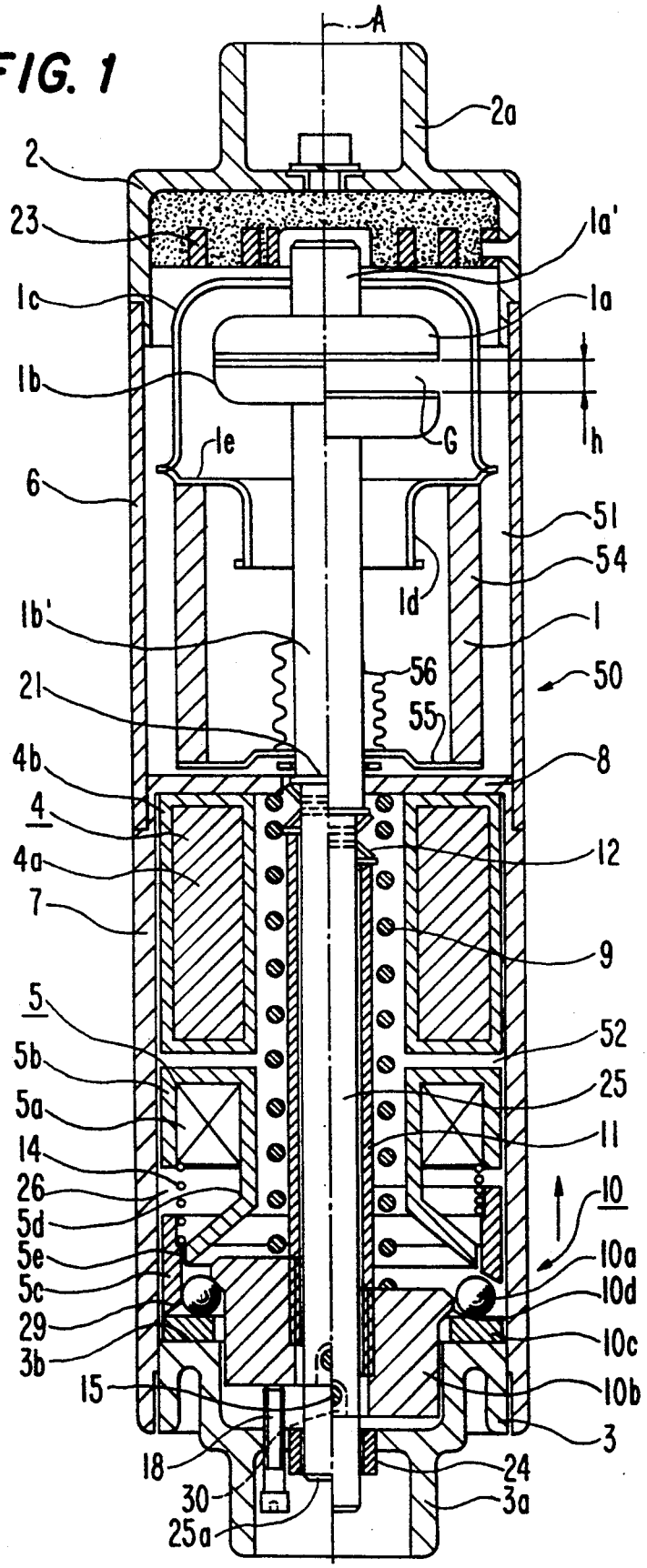
FIG. 1 is a longitudinal, sectional view of a switching device according to the invention, showing the ON position on the left of the center line and the OFF position on the right of the center line.

Referring to FIG. 1, there is shown a particularly advantageous embodiment of a switching device according to the invention which has a cylindrically shaped housing 50 having an interior which is divided into two parts or chambers 51 and 52 by a partition 8. In the first chamber 51, shown in FIG. 1 above partition 8, there is a vacuum switching chamber 1 having a stationary contact 1*a* attached to a stationary shaft 1*a'*, and a movable contact 1*b* attached to a movable shaft 1*b'*. Contacts 1*a* and 1*b* are disposed within a metallic dome element 1*c* which is sealed to shaft 1*a'*. A cylindrical part 1*d* has a radially outwardly extending flange 1*e* connected at its periphery to the rim of dome element 1*c*. A ceramic tube 54, comprised for example of porcelain, is sealingly attached at one end to flange 1*e* and at its opposite end to a bottom closing cover 55 which is sealed to movable shaft 1*b'* by a bellows 56 to provide an air-tight vacuum switching chamber as is known in the art.

Stationary shaft 1*a'* is connected by way of a conductor coil 23 with a first electrical connector 2. Conductor coil 23 generates a magnetic field in a gap G in the opening between separated switch contacts 1*a* and 1*b* which is almost parallel to the switch axis A and thus improves in a known manner the switching capability of vacuum switching chamber 1.

A second chamber 52 disposed below partition 8, accommodates a current transformer 4, a magnet actuator 5, a turn-off spring 9 and a latch 10, following in the listed order below partition 8. Second chamber 52 is terminated by a second electrical connector 3.

First chamber 51 is encased essentially by an insulating tube 6, while second chamber 52 is encased by a metal tube 7. In the open state (contacts 1*a* and 1*b* separated) of vacuum switching chamber 1, a voltage differential is present across switch contacts 1*a*, 1*b*, at the ends of ceramic tube 54 of the vacuum switching chamber 1 and at the ends of insulating tube 6. Since the environment in the interior of the housing is free of contaminants for vacuum switching chamber 1, the length of ceramic tube 54 may be noticeably shorter than the length of insulating tube 6 which may also be subjected to unfavorable environmental influences.

Current transformer 4 has a secondary circuit composed of a toroidal core 4*a* and a secondary coil 4*b* supported thereon, and a primary circuit comprised of the shaft of the movable switch contact 1*b* or, more precisely, its extension 25. The latter is in communication with second connector 3 by way of a sliding contact 24 and is thus traversed by primary current during operation. Magnet actuator 5 includes a toroidal coil 5*a* and a ferromagnetic body 5*b* surrounding it on three sides and having a lower leg 5*d* configured so that it creates a minimum air gap 5*e* relative to a magnet armature 5*c* that is movable in the vertical direction between the free end of lower leg 5*d* and the inner surface of metal tube 7. Magnet armature 5*c* is under the influence of a reset spring 14 which, if toroidal coil 5*a* is not excited, urges magnet armature 5*c* into its rest position where it forms a vertical air gap 26 relative to ferromagnetic body 5*b* (left side of FIG. 1). Current transformer 4 and magnet actuator 5 form an annular gap relative to extension 25 in which, in the present example, turn-off spring 9 is disposed. Turn-off spring 9 has an upper end supported at partition 8 and a lower end which lies against a pressure member 10*b*. In the ON (closed) state of vacuum switching chamber 1 (left side of FIG. 1), pressure member 10*b* has a sloped face 10*d* which is axially supported by way of clamping bodies 10*a* seated on a support plate 10*c*, which in turn is seated on an interior radial surface 3*b* of electrical connector 3. In the ON state, pressure member 10*b* additionally is radially supported by way of clamping bodies 10*a* which lie against magnet armature 5*c*. Pressure member 10*b* also supports a lower end of a contact spring 12, by way of a tube 11 surrounding shaft extension 25. In the disclosed embodiment, contact spring 12 is a plate spring with an upper end which acts by way of a step 21 on shaft 1*b*' of movable switch contact 1*b*.

A pin 15 inserted into extension 25 ensures that the two switch contacts 1*a* and 1*b*, when in the OFF state (right side of FIG. 1), do not exceed a stroke h. Pin 15 may either cooperate with the lower face of pressure member 10*b* or, as shown in FIG. 1, with a groove 30 worked into the pressure member.

At lower connector 3, there is a screw spindle 18 with the aid of which vacuum switching chamber 1 can be turned on again after each interruption of current and turn-off spring 9 can be tightened (compressed) until it is latched by way of pressure member 10*b* and clamping bodies 10*a* as shown on the left side of FIG. 1. However, the switching device according to the invention is ready to switch only after screw spindle 18 has been turned back into its starting position, namely after a required distance has been established between the lower face of pressure member 10*b* and the upper edge of screw spindle 18.

In order to facilitate installation of the switching device according to the invention, lower connector 3 is preferably screwed into metal tube 7.

In the simplest embodiment of the switching device according to the present invention, the provision of a coiled conductor 23 to generate an axial magnetic field may be omitted.

In accordance with the invention, no additional outside energy source is required for the secondary circuit of transformer 4. Rather, secondary winding 4*b* of current transformer 4 is connected directly in series with toroidal coil 5*a* (connection not shown in FIG. 1).

If a fault current occurs in the primary circuit of transformer 4, the following occurs successively within the switching device:

(a) Induction of a corresponding secondary current in secondary winding 4*b*, simultaneously inducing a magnetic field in ferromagnetic body 5*b* of toroidal coil 5*a*, pulling magnet armature 5*c* into air gap 26 against the force of reset spring 14 until magnet armature 5*c* comes in contact with the lower edge of ferromagnetic body 5*b*.

(b) Clamping bodies 10*a*, which are now no longer supported radially by magnet armature 5*c*, are moved toward the outside by sloped face 10*d* of pressure member 10*b* and release the turn-off stroke of the pressure member.

(c) Under action of turn-off spring 9, pressure member 10*b* moves downward until it encounters a stop (not shown) and carries along by way of groove 30 and pin 15 the movable switch contact 1*b* until switching stroke h has been completed between switch contacts 1*a* and 1*b*.

Thus the turn-off process is completed.

The left side of FIG. 1 shows the turned-on state of the switching device and the right side the turned-off state. Since extension 25 of shaft 1*b*' of movable switch contact 1*b*, penetrates the lower delimiting face of connector 3, its end face 25*a* may be provided either with an indicator for the completed turn-off or with a mechanism with the aid of which an associated circuit breaker is moved into a break (tripped) position. As described below in connection with FIGS. 2 and 3, this may be effected by a mechanical rod assembly for actuating a turn-off energy store of the circuit breaker, or by way of an auxiliary contact which gives an electrical signal to turn-off the energy store for tripping the breaker.

The reclosing of the switching device according to the invention will now be described.

(d) Screw spindle 18 is actuated to cause pressure member 10*b* to move upward, simultaneously compressing turn-off spring 9 and bringing switch contacts 1*a* and 1*b* in contact.

(e) After renewed galvanic contact of switch contacts 1*a* and 1*b*, the further rotation of screw spindle 18 causes latch 10 to be brought into its blocking position (left side of FIG. 1). This is done by means of reset spring 14 which acts on magnet armature 5*c*, thus moving clamping bodies 10*a* over sloped face 29 of magnet armature 5*c* into their starting position below sloped face 10*d* of pressure member 10*b*. During this process, a small excess stroke occurs between groove 30 and pin 15 which is required by contact force spring 12 in order to reliably generate the necessary contact force.

(f) Screw spindle 18 is turned back into its starting position so as to re-establish the free path required by pressure member 10*b*.

As a further feature of the present invention, screw spindle 18 may be configured so that, in addition to performing its function as a turn-on mechanism for vacuum switching chamber 1, it also serves as a stop for pressure member 10*b* during each turn-off process.

FIG. 1 further shows that connectors 2 and 3 have connecting faces 2*a* and 3*a*, respectively, which can be employed as adapters for the clamp contacts of EHV fuses. However, other connecting faces can be employed just as well.

Figure 2:
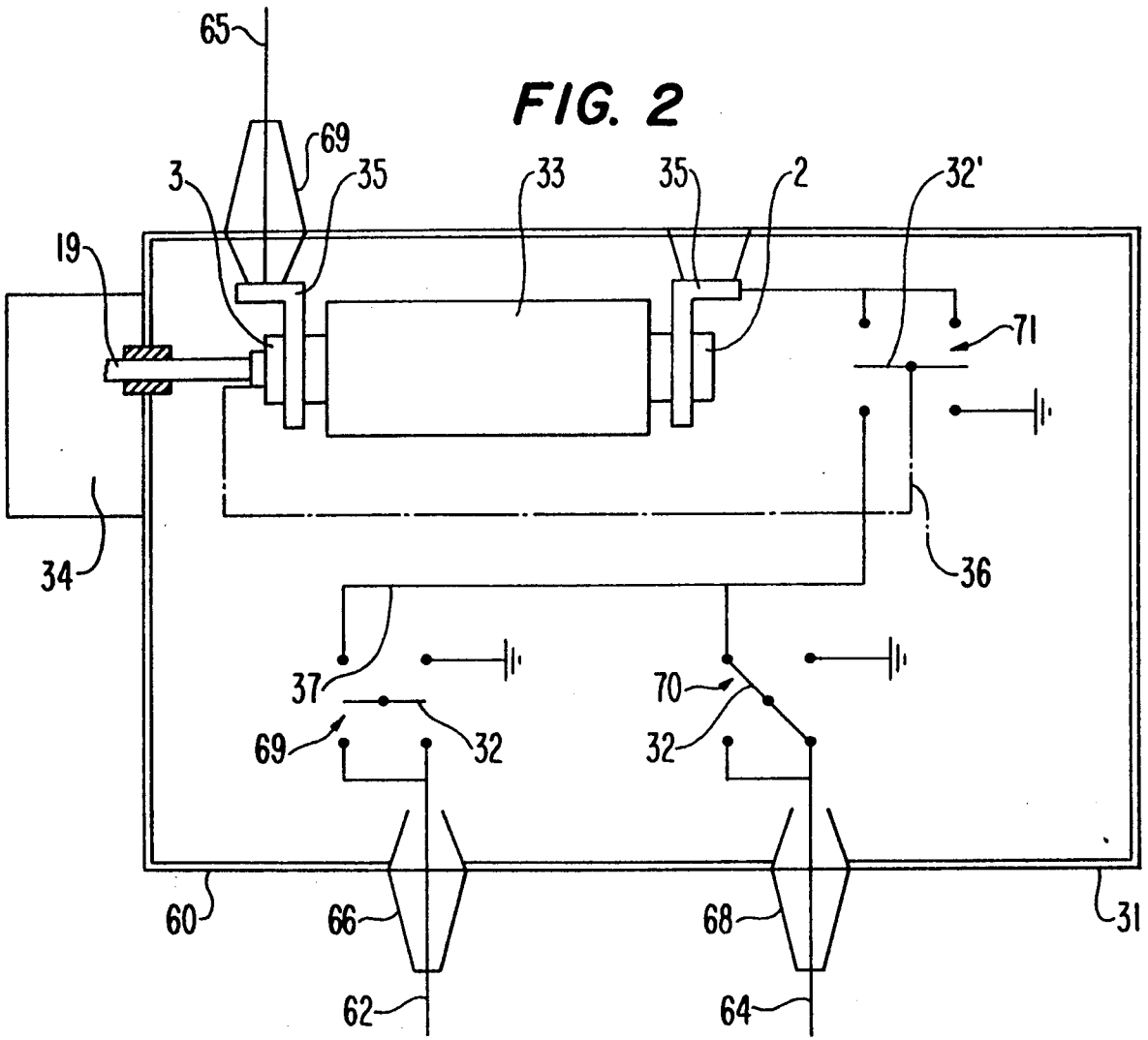
FIG. 2 is a schematic which shows the incorporation of a switching device of the invention in a metal encapsulated, gas insulated switching system (single-phase illustration).

With the switching device according to the invention it is possible, for example, to produce a closed loop switching system according to FIG. 2 wherein there is shown an encapsulation 31 with two cables 62, 64 entering a lower wall of the encapsulation 31 through suitable gas-tight penetrations 66, 68, respectively, and a third cable 65, for example for a transformer branch, entering an upper wall through a similar penetration 69. Cables 62 and 64 may be connected to a bus bar 37 or ground by respective cable connections 69, 70 as shown in the lower portion of the encapsulation. In the upper portion of the encapsulation, bus bar 37 is coupled to the transformer branch by way of another cable connection 71 and a switching device 33 of the type shown in FIG. 1. The fault current protection is here integrated in the encapsulation without requiring the use of a complete operational power switch. Since the switching device according to the present invention is an autonomous unit which requires no outside energy and in which it is not necessary to exchange any components after the successful interruption of a fault current, the device can be fully incorporated in an encapsulated switching system. In this case, the same high insulation level then applies for it as for all other operating means included in the switching system.

More particulary, the closed loop switching system according to FIG. 2 is provided, for example, in its lower portion with two three-position switches 32 with which cables 62 and 64, respectively, can be connected with bus bar 37 or with which each individual cable can be separated or grounded. Toward the top, bus bar 37 is connected with a further three-position switch 32' whose switch contacts are connected to switching device 33 according to the invention for the interruption of fault currents. Switching device 33 is provided with two clamping contacts 35 and associated insulators on encapsulation 31. Switching device 33 is oriented so that second connector 3 is oriented toward one of the walls of the encapsulation. Screw spindle 18 (not shown in FIG. 2) is extended in the form of an insulated shaft 19, which is brought to the exterior of the switching system in a gas tight manner. With the aid of insulated shaft 19, switching device 33 can be turned on again and turn-off spring 9 can be set in compression and latched either manually or by way of a motor drive 34 once the fault current has been interrupted.

The switching device according to the invention is a single-phase switching device. End face 25*a* (see FIG. 1) of switching device 33 according to the invention may be connected with one end of a rod assembly 36 which is connected at another end to three-position switch 32' in order to separate the branch circuit after a fault current has been interrupted. In networks having a rigid neutral point ground connection or, if it should be necessary for other reasons, three-position switch 32' may be equipped with single-phase actuation.

Figure 3:
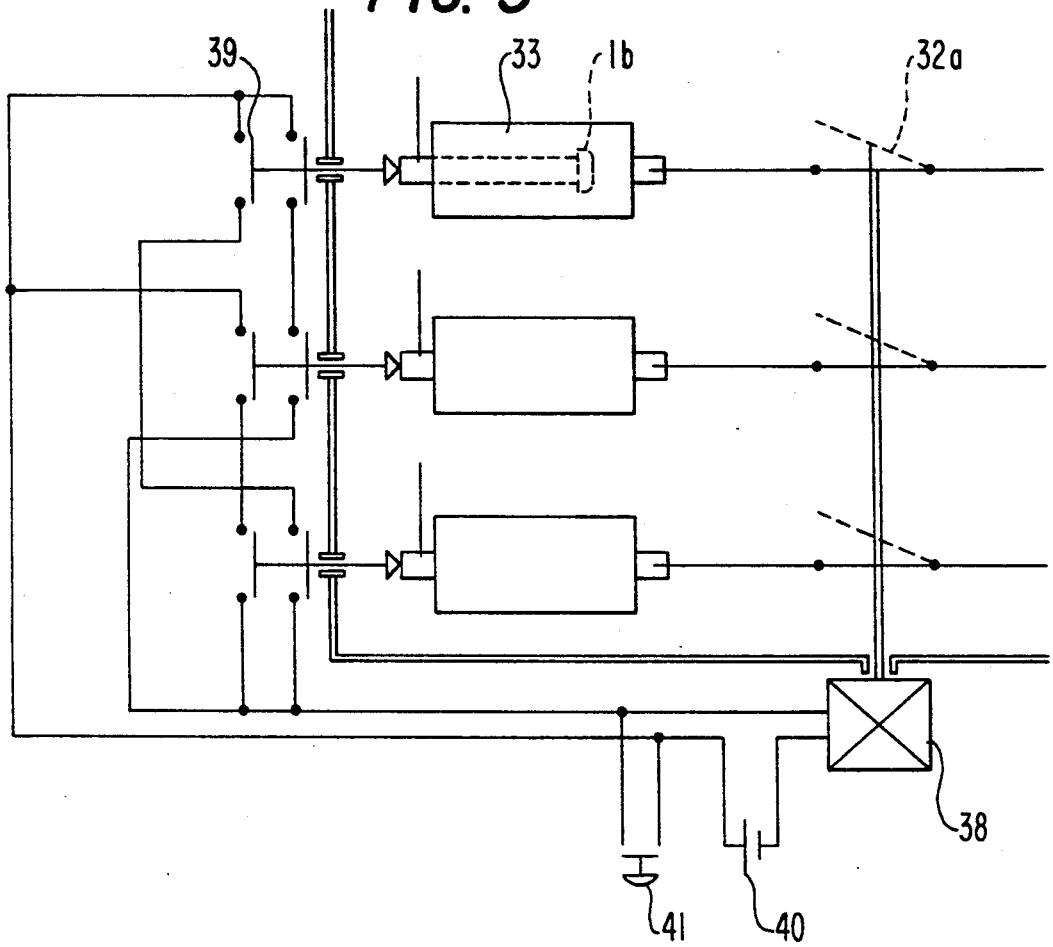
FIG. 3 is a circuit diagram showing three single-phase switching devices of the invention and a three-phase power circuit breaker linked together by way of an electrical control according to another aspect of the invention.

FIG. 3 shows how, by means of an electrical control, three single-phase switching devices 33 and a three-phase power circuit breaker 32*a* are linked together and a fault current interruption in only one phase need not lead to the separation of the power circuit breaker 32*a*. That is, according to the embodiment of FIG. 3, only a two-phase or three-phase fault current interruption leads to the final breaking of the circuit. Each movable switch contact 1*b* of the three switching devices 33 is connected with a pair of two-pole auxiliary switches 39 that are disposed outside of encapsulation 31. The three pairs of auxiliary switches 39 are interconnected so that one auxiliary contact of each interrupted phase is connected in series with an auxiliary contact of another interrupted phase and is in communication with an operating current actuator of a control device 38. Control device 38 may be actuated intentionally by way of a push button 41, and also automatically in the case of a fault by way of auxiliary switches 39. That is, in the case of automatic actuation, the connecting lines between auxiliary switches 39 of the individual phases are connected so that the operating current actuator of control device 38 has voltage applied to it only if two current phases are interrupted by way of two vacuum switching chambers. If there is a single-phase interruption, so that only one auxiliary switch contact is closed, no control voltage is present at control device 38.

The inventive switching device according to FIG. 1 may be employed to great advantage also in air insulated switching systems. In such cases, the housing is configured and sealed so that corrosive influences from the environment are unable to penetrate into the interior of the switching device. The length of insulating tube 6 is also adapted to the harder environmental influences.

In some cases it is desirable not to have an immediate response in the case of a fault. For this purpose, the conventional switching systems employ an adjustable excess current relay with which the response period of the actuating devices can be varied. However, such relays have the disadvantage that they must be checked out at certain time intervals. Yet, this is permissible only if the branch has been separated.

Figure 4:
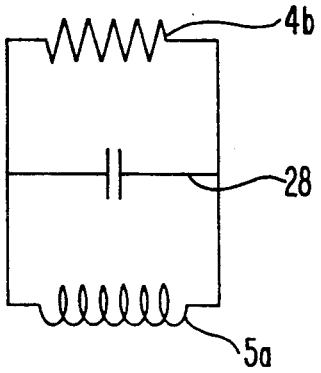
FIG. 4 is a circuit diagram for the secondary circuit including a capacitance.
Figure 5:
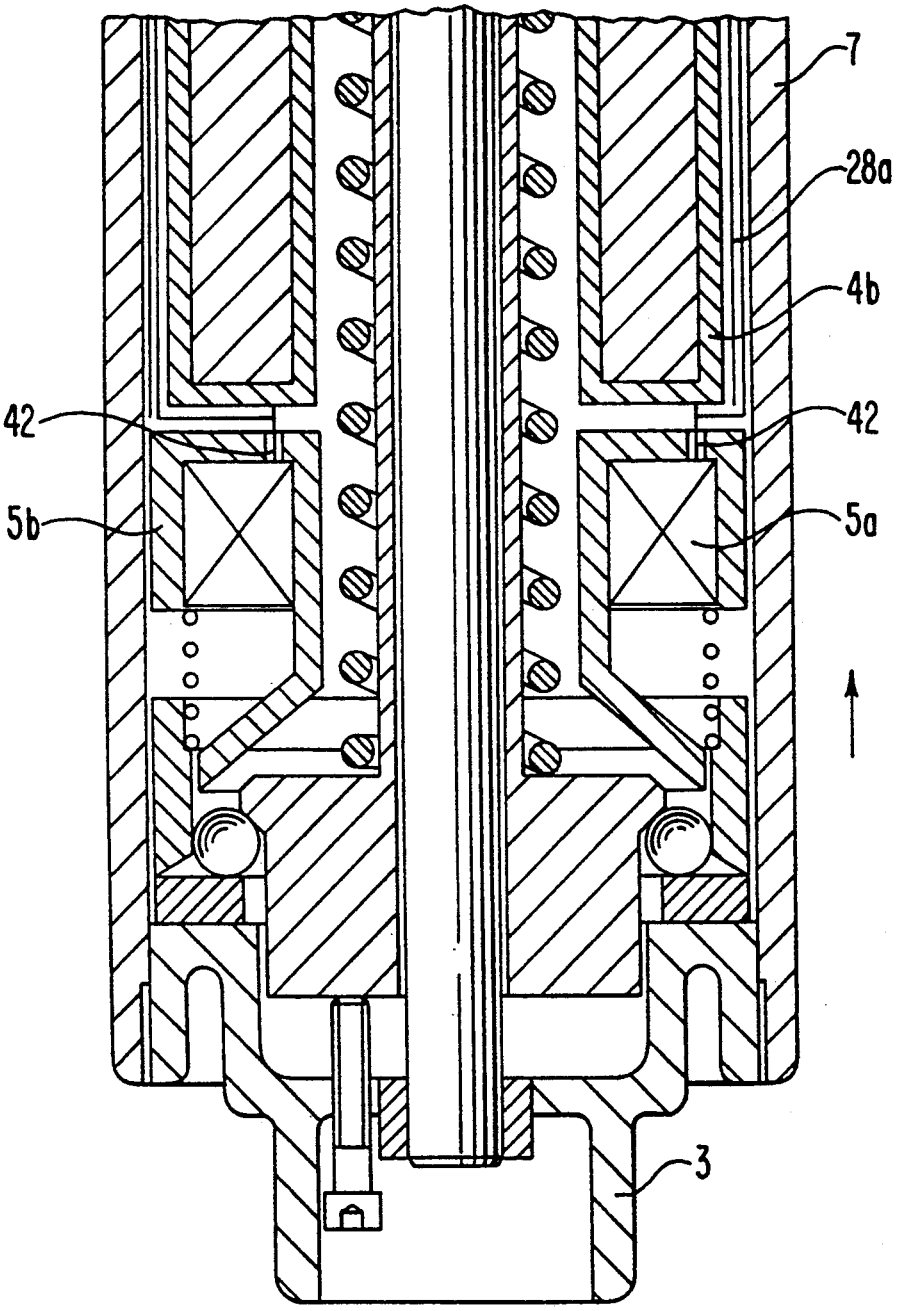
FIG. 5 is a partial longitudinal sectional view which shows the switching device of the invention with a wound capacitor.
Figure 6:
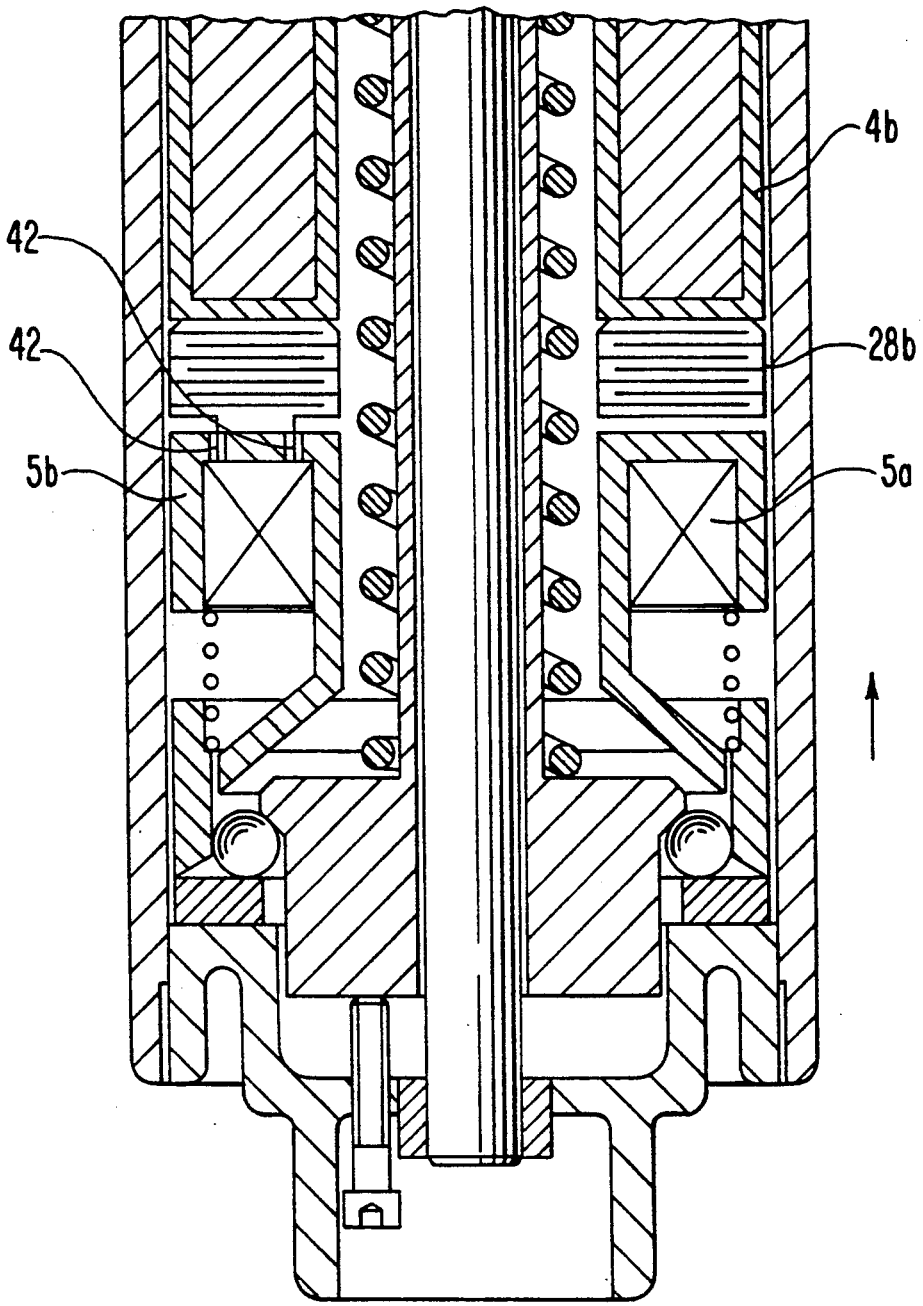
FIG. 6 is a similar view as FIG. 5 showing the switching device of the invention with a plate capacitor.

Extended actuation times can be realized with a further feature of the switching device according to the invention with the addition of a capacitance 28, preferably parallel with toroidal coil 5*a* of magnet actuator 5 as shown in FIG. 4. The capacitance may be configured, as shown in FIG. 5, as a cylindrical capacitor 28*a*. Cylindrical capacitor 28*a* is advantageously disposed in a gap between secondary winding 4*b* of current transformer 4 and metal tube 7 of the housing. FIG. 4 shows the interconnections of capacitor 28*a* with secondary winding 4*b* and toroidal coil 5*a*.

According to another feature of the invention, a plate capacitor 28*b* can also be employed as the capacitance for influencing the turn-off time of the switching device. This plate capacitor 28*b* may advantageously be disposed between current transformer 4 and magnet actuator 5. Here again the interconnections are made according to the circuit diagram of FIG. 4. In all cases, openings 42 are provided in ferromagnetic body 5*b* through which the electrical connection to the capacitors and to the secondary coil 4*b* of current transformer 4 are drawn.

Obviously, numerous and additional modifications and variations of the present invention are possible in light of the above teachings. It is therefore to be understood that within the scope of the appended claims, the invention may be practiced otherwise than as specifically claimed.

What is claimed is:

1. A switching device for the interruption of a fault current, comprising:

a cylindrically shaped housing including: first and second electrical connectors for connection in the path of an electrical conductor carrying a single current phase; a partition separating said housing into first and second chambers; an insulating tube having an end face terminated at least in part by said first electrical connector which together form an exterior surface of said first chamber; a metal tube sealed against said first chamber by said partition, said metal tube having an end face within which said second electrical connector is inserted, with said metal tube and said second connector forming an exterior surface of said second chamber;

a vacuum switching chamber disposed in said first chamber, and coaxially arranged in said housing;

a stationary switch contact and a movable switch contact disposed in said vacuum switching chamber;

a shaft connected to said movable switch contact and penetrating said partition toward said second chamber;

first connection means disposed in said first chamber for connecting said stationary switch contact to said first electrical connector;

second connection means disposed in said second chamber for creating a displaceable contact connection between said shaft and said second electrical connector for electrically connecting said movable switch contact with said second electrical connector;

a current transformer disposed in said second chamber, coaxially arranged in said housing and including a secondary winding, and a primary circuit connected between said first and second electrical connectors for conducting said single current phase and inducing a corresponding current in said secondary winding;

magnet actuator means disposed in said second chamber, coaxially arranged in said housing and electrically connected in a circuit with said secondary winding of said current transformer, said magnet actuator means having an inactive state and an actuated state and being responsive to a fault current in said primary circuit of said current transformer, by way of the corresponding current in said secondary winding, for changing from the inactive state to the actuated state;

latch means disposed in said second chamber, coaxially arranged in said housing and coupled to said movable switch contact for latching said movable switch contact in a closed position with respect to said stationary switch contact and for being unlatched in response to a change to the actuated state of said magnet actuator means for moving said movable switch contact to an open position relative to said stationary switch contact;

a turn-off spring disposed in said second chamber and coaxially arranged in said housing for storing a spring force and operatively associated with said latch means for causing said latch means, under influence of the spring force, to separate said movable switch contact from said stationary switch contact when said latch means becomes unlatched; and reset means operatively connected to said latch means for causing said latch means to latch said movable switch contact in the closed position and for restoring the spring force of said turn-off spring after said latch means is unlatched in response to a fault current.

2. A switching device for the interruption of a fault current, comprising:

a housing including first and second electrical connectors for connection in the path of an electrical conductor carrying a single current phase, said housing being associated solely with the single current phase, said housing having a first chamber, a second chamber and a partition separating said first and second chambers;

a vacuum switching chamber disposed in said first chamber;

a stationary switch contact and a movable switch contact disposed in said vacuum switching chamber;

a shaft connected to said movable switch contact and penetrating said partition toward said second chamber;

first connection means disposed in said first chamber for connecting said stationary switch contact to said first electrical connector;

second connection means disposed in said second chamber for creating a displaceable contact connection between said shaft and said second electrical connector for electrically connecting said movable switch contact with said second electrical connector;

a current transformer disposed in said second chamber adjacent said partition and including a toroidal core surrounding said shaft of said movable switch contact, a secondary winding mounted on said toroidal core, and a primary circuit connected between said first and second electrical connectors for conducting the single current phase and inducing a corresponding current in said secondary winding, said shaft constituting said primary circuit of said current transformer;

magnet actuator means disposed in said second chamber following said current transformer in a direction away from said partition and electrically connected in a circuit with said secondary winding of said current transformer, said magnet actuator including a toroidal coil surrounding said shaft, a ferromagnetic body at least partially enclosing said toroidal coil and defining an air gap, and a displaceable magnet armature disposed in said air gap, said magnet actuator means having an inactive state and an actuated state and being responsive to a fault current in said primary circuit of said current transformer, by way of the corresponding current in said secondary winding, for changing from the inactive state to the actuated state;

latch means disposed in said second chamber following said magnet actuator means in the direction away from said partition, said latch means coupled to said movable switch contact for latching said movable switch contact in a closed position with respect to said stationary switch contact and for being unlatched in response to a change to the actuated state of said magnet actuator means for moving said movable switch contact to an open position relative to said stationary switch contact;

a turn-off spring disposed in said second chamber, for storing a spring force and operatively associated with said latch means for causing said latch means, under influence of the spring force, to separate said movable switch contact from said stationary switch contact when said latch means becomes unlatched; and reset means operatively connected to said latch means for causing said latch means to latch said movable switch contact in the closed position and for restoring the spring force of said turn-off spring after said latch means is unlatched in response to a fault current.

3. A switching device for the interruption of a fault current, comprising:

a housing including first and second electrical connectors for connection in the path of an electrical conductor carrying a single current phase, said housing being associated solely with the single current phase, said housing having a first chamber, a second chamber and a partition separating said first and second chambers;

a vacuum switching chamber disposed in said first chamber;

a stationary switch contact and a movable switch contact disposed in said vacuum switching chamber and connected;

a shaft connected to said movable switch contact and penetrating said partition toward said second chamber;

first connection means disposed in said first chamber for connecting said stationary switch contact to said first electrical connector;

second connection means disposed in said second chamber for creating a displaceable contact connection between said shaft and said second electrical connector for electrically connecting said movable switch contact with said second electrical connector, said displaceable contact connection including a sliding contact connected to said second electrical connector;

a current transformer disposed in said second chamber, said current transformer including a secondary winding, and a primary circuit connected between said first and second electrical connectors for conducting said single current phase and inducing a corresponding current in said secondary winding;

magnet actuator means disposed in said second chamber and electrically connected in a circuit with said secondary winding of said current transformer, said magnet actuator means having an inactive state and an actuated state and being responsive to a fault current in said primary circuit of said current transformer, by way of the corresponding current in said secondary winding, for changing from the inactive state to the actuated state;

latch means disposed in said second chamber, coupled to said movable switch contact for latching said movable switch contact in a closed position with respect to said stationary switch contact and for being unlatched in response to a change to the actuated state of said magnet actuator means for moving said movable switch contact to an open position relative to said stationary switch contact;

a turn-off spring disposed in said second chamber, for storing a spring force and operatively associated with said latch means for causing said latch means, under influence of the spring force, to separate said movable switch contact from said stationary switch contact when said latch means becomes unlatched; and reset means operatively connected to said latch means for causing said latch means to latch said movable switch contact in the closed position and for restoring the spring force of said turn-off spring after said latch means is unlatched in response to a fault current.

4. A switching device for the interruption of a fault current forming a combination with a power circuit breaker, said switching device, comprising:

a housing including first and second electrical connectors for connection in the path of an electrical conductor carrying a single current phase, said housing being associated solely with the single current phase;

a vacuum switching chamber disposed in said housing;

a stationary switch contact and a movable switch contact disposed in said vacuum switching chamber and connected, respectively, to said first and second electrical connectors;

a current transformer disposed in said housing, said current transformer including a secondary winding, and a primary circuit connected between said first and second electrical connectors for conducting the single current phase and inducing a corresponding current in said secondary winding;

magnet actuator means disposed in said housing and electrically connected in a circuit with said secondary winding of said transformer, said magnet actuator means having an inactive state and an actuated state and being responsive to a fault current in said primary circuit of said current transformer, by way of the corresponding current in said secondary winding, for changing from the inactive state to the actuated state;

latch means disposed in said housing, coupled to said movable switch contact for latching said movable switch contact in a closed position with respect to said stationary switch contact and for being unlatched in response to a change to the actuated state of said magnet actuator means for moving the movable switch contact to an open position relative to said stationary switch contact;

a turn-off spring for storing a spring force and operatively associated with said latch means for causing said latch means, under influence of the spring force, to separate said movable switch contact from said stationary switch contact when said latch means becomes unlatched; and reset means operatively connected to said latch means for causing said latch means to latch said movable switch contact in the closed position and for restoring the spring force of said turn-off spring after said latch means is unlatched in response to a fault current, said combination including means operatively connected between said movable switch contact and said power circuit breaker to open said power circuit breaker in response to a movement of said movable switch contact which separates said movable and stationary switch contacts.

5. The device as defined in claim 3, wherein said housing includes means for indicating the position of said movable switch contact.

6. The device as defined in claim 2, wherein said latch means includes a displaceable pressure member coupled to said shaft and said current transformer and said magnet actuator means form an annular gap relative to said shaft in which said turn-off spring is disposed, said turn-off spring being supported at said partition and at said pressure member.

7. The device as defined in claim 6, wherein said housing has a cylindrical shape within which said vacuum switching chamber, said current transformer, said magnet actuator means, said turn-off spring, and said latch means are incorporated in a coaxial arrangement; said latch means further includes a supporting plate and at least one clamping body, said pressure member has a sloped surface oriented at an angle relative to the longitudinal axis of said cylindrical housing, and, in the closed position of said contacts, said pressure member acts by way of said sloped surface on said at least one clamping body which is disposed so that said at least one clamping body is supported with an axial force component on said supporting plate and with a radial force component on an interior face of said magnet armature.

8. The device as defined in claim 7, wherein the toroidal coil of said magnet actuator means is responsive to an induced current in the secondary winding of said current transformer corresponding to a fault current in said primary circuit for pulling said magnet armature into said air gap, whereupon said at least one clamping body moves outwardly under the effect of a radial force component produced by said turn-off spring by way of the sloped surface of said pressure member, thereby releasing said pressure member, together with said shaft and said movable contact, to move axially in a direction for separating said contacts.

9. The device as defined in claim 6, further comprising a pin attached to the shaft of said movable switch contact, said pressure member transferring the force of said turn-off spring to said pin for separating said contacts.

10. The device as defined in claim 9, wherein said shaft has a radial step and said device further comprises contact force spring disposed between said radial step and said pressure member, said contact force spring being supported at said pin when said contacts are in the open position.

11. The device as defined in claim 10, wherein said reset means comprises a screw spindle supported in said second electrical connector and operatively connected with said turn-off spring for stressing said turn-off spring.

12. The device as defined in claim 11 forming a combination with a encapsulation in which said device is accommodated, wherein said combination further comprises an insulated shaft connected to said screw spindle and extending outside of said encapsulation for actuating said screw spindle from outside said encapsulation.

13. The combination as defined in claim 12, further comprising motor drive means connected to said screw spindle for actuating said screw spindle to stress said turn-off spring and to reset said latch means for closing said contacts, said motor drive means including means for automatically actuating said screw spindle upon removal of a fault and automatic return of said screw spindle after completion of closing said contacts.

14. The device as defined in claim 2, wherein said magnet actuator means further includes a reset spring disposed under compression in the gap defined by said ferromagnetic body and applying a spring biasing force against said magnet armature; and said magnet armature has a sloped end face which, after the spring force of said turn-off spring is restored by said reset means, and under the influence of said reset spring, guides said at least one clamping body into a blocking position with respect to said latch means for latching said movable contact in the closed position.

15. The device as defined in claim 2, wherein the secondary winding of said current transformer and the toroidal coil of said magnet actuator means are connected in series.

16. The device as defined in claim 15, further comprising capacitor means connected in parallel with said toroidal coil.

17. The device as defined in claim 16, wherein said capacitor means comprises a wound capacitor arranged around the secondary winding of said current transformer.

18. The device as defined in claim 16, wherein said capacitor means comprises a plate capacitor disposed between said current transformer and said magnet actuator means.

19. The device as defined in claim 3, wherein said first connection means includes a shaft connected to said stationary switch contact and connected to an interior region of said first electrical connector by way of a screw connection.

20. The device as defined in claim 3, wherein said first connection means includes a coil-shaped conductor disposed between said first electrical connector and said stationary switch contact for generating an axial magnetic field.

21. The device as defined in claim 20, wherein said coil-shaped conductor is wound in the shape of a spiral having an outer end conductively connected with said first electrical connector and an inner end conductively connected with said stationary switch contact.

22. The device as defined in claim 21, and further comprising a shaft connected to said stationary switch contact and insulatedly mounted in said first connector by way of a screw connection.

23. The device as defined in claim 3, wherein said first and second electrical connectors include adapters for accommodating clamping contacts intended for high power fuses.

24. The combination as defined in claim 4, wherein said device includes a shaft connected to said movable switch contact and having an end projecting from said housing; and said combination further includes: control means having a control input and an output connected to said power circuit breaker for tripping said power circuit breaker; and rod assembly means coupled between the end of said shaft and the control input of said control means for actuating said control means to trip said power circuit breaker in response to a movement of said movable contact being separated from said stationary contact.

25. The combination as defined in claim 4, wherein said device includes a shaft connected to said movable switch contact and having an end projecting from said housing; and said combination further comprises: an encapsulation enclosing a plurality of said devices having respective shaft ends projecting from the respective housings; auxiliary contact means coupled to said shaft ends; a plurality of said power circuit breakers each carrying a different current phase and connected in series with a stationary contact of a respective one of said devices; control means including a current actuator and having an output connected to said power circuit breakers for tripping said power circuit breakers when said current actuator is charged by a signal delivered by way of said auxiliary contact means after at least one of the movable contacts is moved to an open position in response to a fault current.

26. The combination as defined in claim 25, wherein said auxiliary contact means is disposed outside of said encapsulation.

27. The combination as defined in claim 25, wherein said auxiliary contact means includes two sets of contacts operatively associated with each shaft end of the respective devices, with the sets of contacts associated with the plurality of said devices being connected so that when any two of said devices are turned off, one set of contacts from one of the turned off devices is connected in series with one set of contacts from the other turned off device and the two series connected sets of contacts are connected in series with the current actuator of said control device.

* * * * *